US006945270B1

(12) United States Patent
Su

(10) Patent No.: US 6,945,270 B1
(45) Date of Patent: Sep. 20, 2005

(54) REELING DEVICE FOR HOSES

(76) Inventor: Cheng-Wen Su, No. 26-1, An-Hsi Chuang, An-Hsi Li, Changhwa City, Changhwa Hsien (TW)

( * ) Notice: Subject to any disclaimer, the term of this patent is extended or adjusted under 35 U.S.C. 154(b) by 0 days.

(21) Appl. No.: 10/872,421

(22) Filed: Jun. 22, 2004

(51) Int. Cl.[7] ..... B65H 75/34
(52) U.S. Cl. ..... 137/355.17; 137/355.16; 137/360; 242/405.1
(58) Field of Search ..... 137/355.17, 355.16, 137/360; 242/405, 405.1

(56) References Cited

U.S. PATENT DOCUMENTS 1,746,995 A * 2/1930 Edwards ..... 137/355.17
2,629,630 A * 2/1953 Roark ..... 137/355.17
4,713,497 A * 12/1987 Smith ..... 191/12.2 R
6,588,444 B2 * 7/2003 Paplow et al. ..... 137/15.01
6,786,428 B1 * 9/2004 Huang ..... 239/198

* cited by examiner

*Primary Examiner*—A. Michael Chambers
(74) *Attorney, Agent, or Firm*—Bacon & Thomas PLLC

(57) ABSTRACT

A reeling device has a base, two reeling wheels, a connector assembly and two handlebars. The base has two chambers and two notches communicate respectively with the chambers. The reeling wheels are rotatably attached respectively inside the chambers for hoses being mounted around the reeling wheels. The connector assembly is attached to the reeling wheels and the base and has an input connector and an output connector. Each one of the input connector and the out connector has a combining end combined with each other. The handlebars are pivotally attached respectively to the reeling wheels. Accordingly, the hoses can be expanded in different way to make the reeling device convenient and versatile in use.

17 Claims, 6 Drawing Sheets

REELING DEVICE FOR HOSES

BACKGROUND OF THE INVENTION

1. Field of the Invention

The present invention relates to a reeling device, and more particularly to a reeling device for hoses that can be expanded from the reeling device respectively in different directions.

2. Description of Related Art

A reeling device for reeling a hose can assist a user to carry the hose to a desired place, such as grassland or a courtyard, and the user can spray water to the grassland or the courtyard with the hose conveniently. A conventional reeling device substantially comprises a base and a reeling wheel. The reeling wheel is rotatably mounted on the base for a hose being wound around the reeling wheel. One end of the hose is connected to a water source with a connector, and the other end of the hose is provided with a sprayhead, a sprinkler or the like. Accordingly, the user can use the hose at any desired location, and the use of the hose is convenient.

However, only one hose can be wound on the conventional reeling wheel, so the operational distance of the hose is limited at the length of the hose and cannot be expanded so that use of the hose is inconvenient and the conventional reeling device is not versatile in use.

To overcome the shortcomings, the present invention tends to provide a reeling device to mitigate or obviate the aforementioned problems.

SUMMARY OF THE INVENTION

The main objective of the invention is to provide a reeling device that can reel around two hoses to make the hoses being expanded in different way so as to make the reeling device convenient and versatile in use. The reeling device has a base, two reeling wheels, a connector assembly and two handlebars. The base has two chambers defined respectively in sides to form a partition wall between the chambers. Two notches are defined in the base and communicate respectively with the chambers. The reeling wheels are rotatably attached respectively inside the chambers in the base for hoses being mounted around the reeling wheels and includes a first reeling wheel and a second reeling wheel. The connector assembly is attached to the reeling wheels and the base and has an input connector and an output connector. The input connector is attached to the first reeling wheel to rotatably attach the first reeling wheel to the base and has a combining end extending into the base. The output connector is attached to the second reeling wheel to rotatably attach the second reeling wheel to the base and has a combining end extending into the base and connected with the combining end of the input connector. An O-ring is mounted between the combining ends of the input connector and the output connector. The handlebars are pivotally attached respectively to the reeling wheels.

Other objects, advantages and novel features of the invention will become more apparent from the following detailed description when taken in conjunction with the accompanying drawings.

DETAILED DESCRIPTION OF PREFERRED EMBODIMENT

Figure 1:
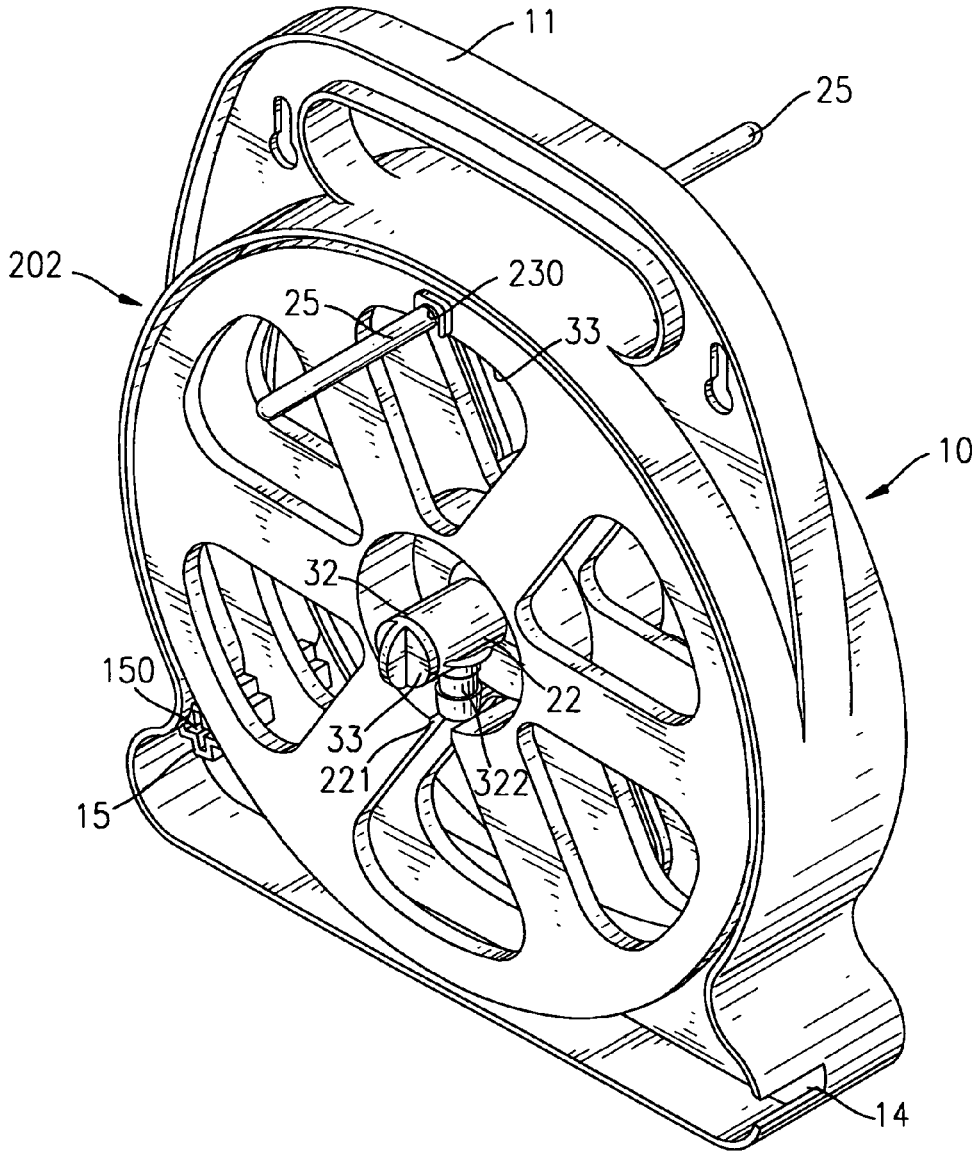
FIG. 1 is a perspective view of a reeling device in accordance with the present invention.
Figure 2:
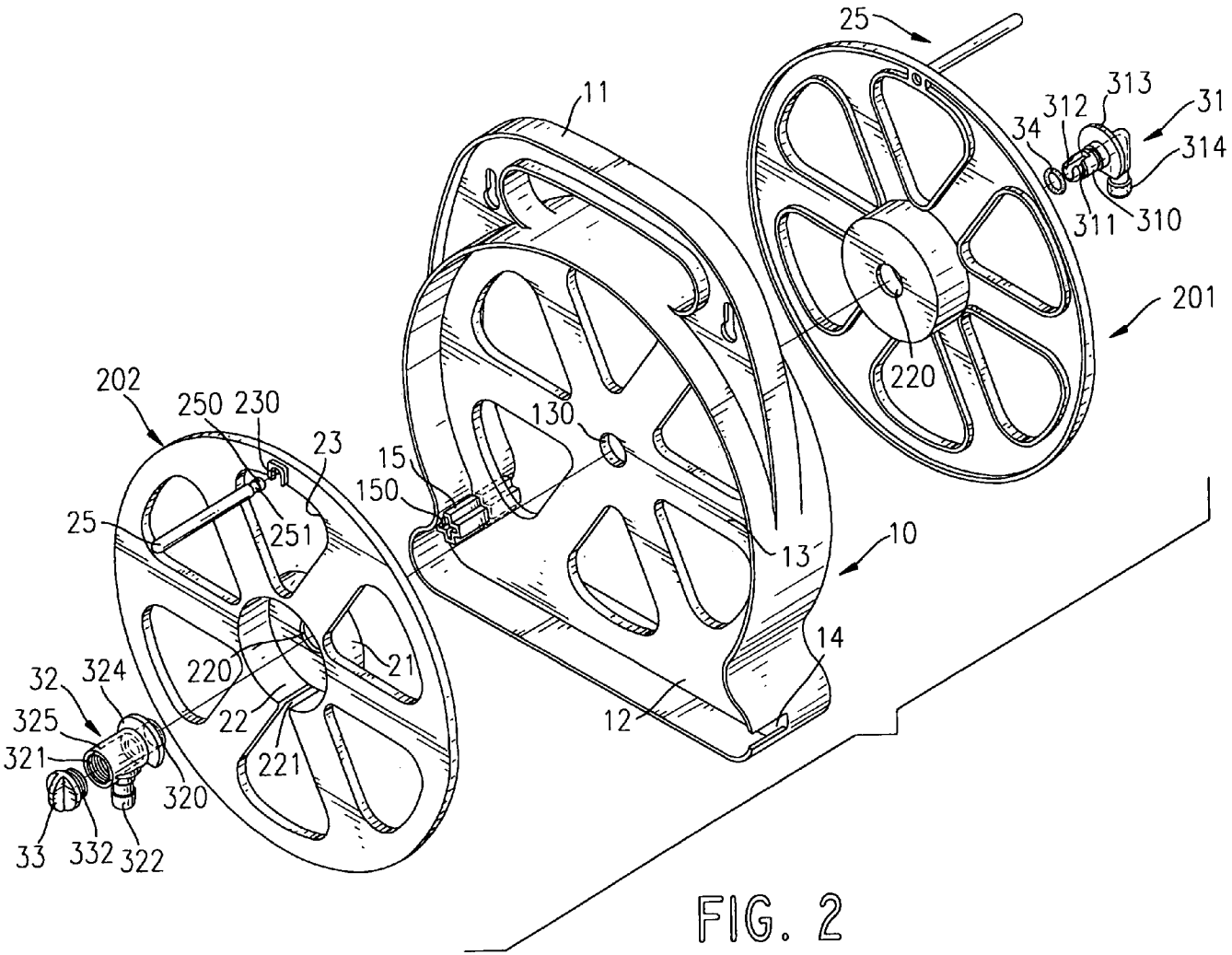
FIG. 2 is an exploded perspective view of the reeling device in FIG. 1.
Figure 3:
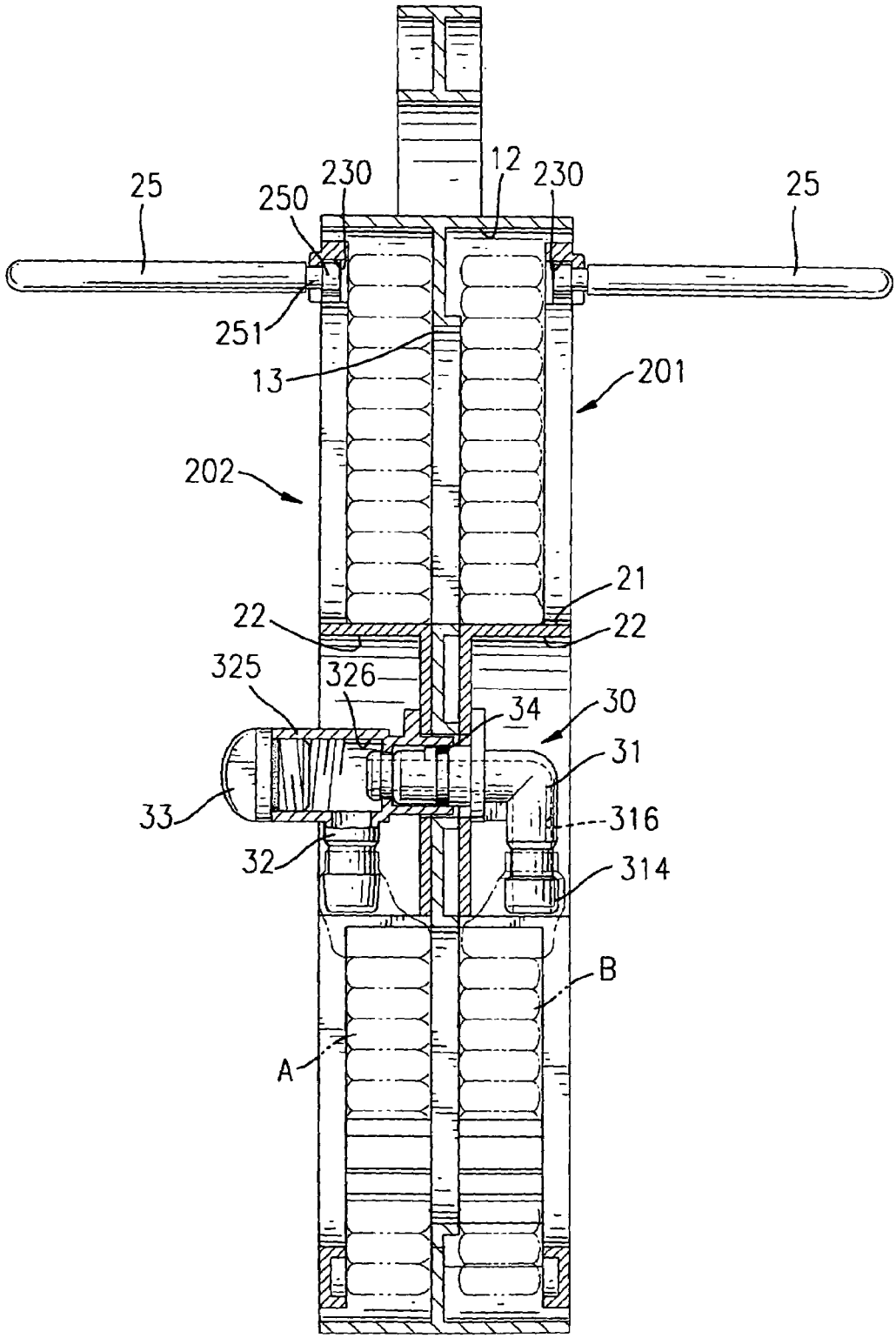
FIG. 3 is a side plan view in partial cross section of the reeling device in FIG. 1.

With reference to FIGS. 1 to 3, a reeling device for hoses in accordance with the present invention comprises a base (10), two reeling wheels (201,202), a connector assembly (30) and two handlebars (25). The base (10) has two sides, two chambers (12) and two notches (14). The chambers (12) are defined respectively in the sides to form a partition wall (13) between the chambers (12). A central hole (130) is defined through the partition wall (13). The notches (14) are defined in the base (10) and communicate respectively with the chambers (12). In practice, the notches (14) are defined at opposite ends on the base (10).

In addition, a handle (11) is formed on the base (10) for a user conveniently carrying the reeling device. Two rod mounts (15) are formed respectively in the chambers (120 and extend from the partition wall (13). Each rod mount (15) has a free end and an inserted hole (150) defined in the free end.

The reeling wheels (201,202) includes a first reeling wheel (201) and a second reeling wheel (202) and is rotatably attached respectively inside the chambers (12) in the base (10) for hoses (A,B) being mounted around the reeling wheels (201,202). Each reeling wheel (201,202) has multiple through holes (23), a pivotal hole (230) and a protrusion (21). The through holes (23) are defined through the reeling wheel (201,202), and each has an inner surface. The pivotal hole (230) is defined in the inner surface of one of the through holes (23) for one end of one of the handlebars (25) being pivotally attached inside the pivotal hole (230). The protrusion (21) protrudes from one side of the reeling wheel (201,202) and extends into a corresponding chamber (12) in the base (10) for a hose (A,B) being wound around the protrusion (21). A recess (22) is defined in the protrusion (21) at a side opposite to the base (10) and has a bottom and an inner surface. A central hole (220) is defined through the bottom of the recess (22) and aligns with the central hole (130) in the partition wall (13) of the base (10). A slit (221) is defined in the inner surface of the recess (22) and communicates with one of the through holes (23) in the reeling wheel (201,202).

Figure 4:
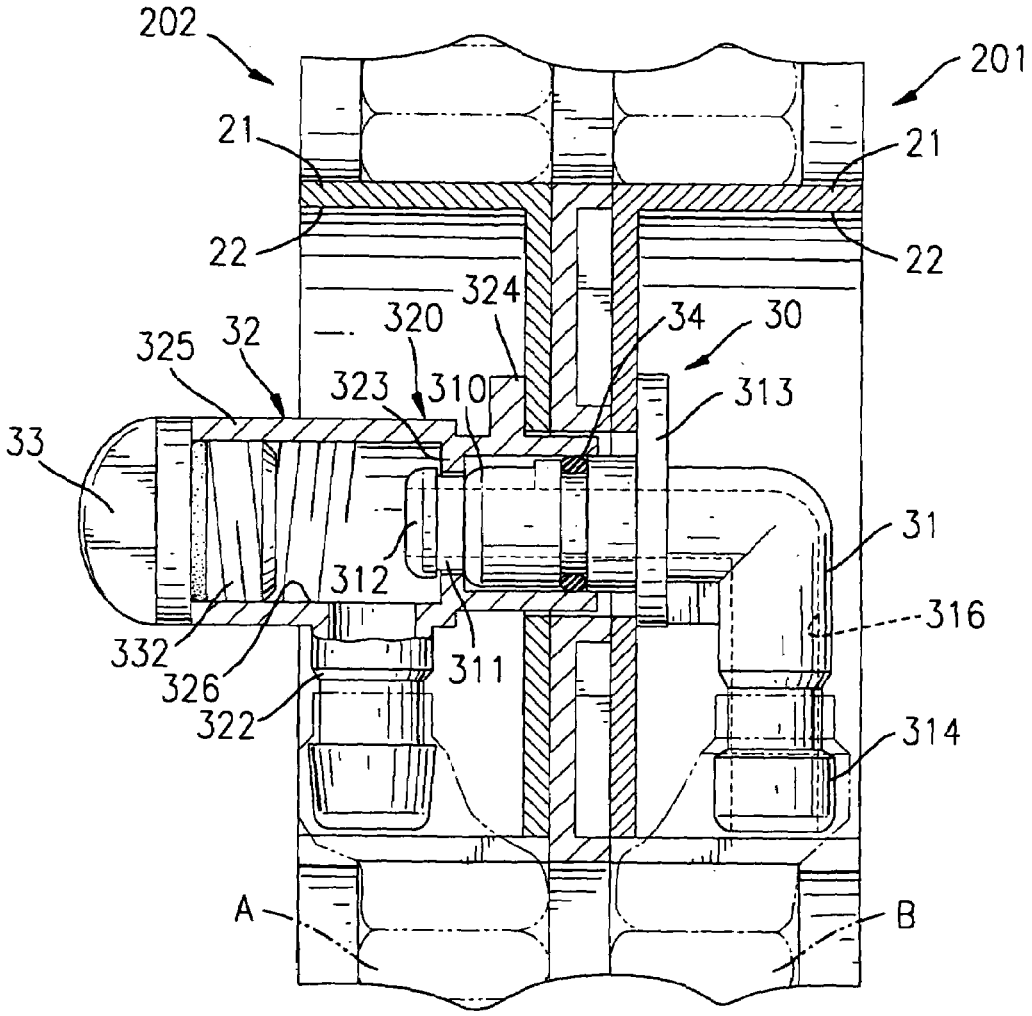
FIG. 4 is an enlarged side plan view in partial cross section of the connector assembly of the reeling device in FIG. 3.

With further reference to FIG. 4, the connector assembly (30) is attached to the reeling wheels (201,202) and the base (10) and comprises an input connector (31) and an output connector (32). The input connector (31) is attached to the first reeling wheel (201) to rotatably attach the first reeling wheel (201) to the base (10). In an optional embodiment, the input connector (31) is L-shaped and has a combing end (310) and a hose-connecting end (314). The combining end (310) extends through the central holes (220,130) in the first reeling wheel (201) and the base (10). The hose-connecting end (314) is opposite to the combining end (310) and is adapted for a hose (B) that is connected to a water source being attached to the hose-connecting end (314). The input connector (31) has an input channel (316) defined through the input connector (31) from the hose-connecting end (314) to the combining end (310).

The output connector (32) is attached to the second reeling wheel (202) to rotatably attach the second reeling wheel (202) to the base (10). In an optional embodiment, the output connector (32) is T-shaped and has a combining end (320), an auxiliary connecting end (325) and a hose-connecting end (322). The combining end (320) extends through the central hole (22) in the second reeling wheel (202) and into the central hole (130) in the base (10). The combining end (320) is connected with the combining end (310) of the input connector (31). In practice, the combining end (310) of the input connector (31) is inserted into the combining end (320) of the output connector (32). The input connector (31) has an annular groove (311) defined around the input connector (31) near the combining end (310). The output connector (32) has an engaging flange (323) formed inside the output connector (32) near the combining end (320) and engaging with the groove (311) in the input connector (31) to combine the input connector (31) with the output connector (32). The output connector (32) has an output channel (326) defined through the output connector (32) from the combining end (320) to the hose-connecting end (322) and the auxiliary connecting end (325) and communicates with the input channel (316) in the input connector (31).

An O-ring (34) is mounted between the combining ends (310,320) of the input connector (31) and the output connector (32) to keep leakage from occurring on the conjunction of the input connector (31) and the output connector (32).

The auxiliary connecting end (325) of the output connector (32) is opposite to the combining end (320). A plug (33) is detachably attached to the auxiliary connecting end (325). In a preferred embodiment, an inner thread (321) is defined in the auxiliary connecting end (325) of the output connector (32), and a thread (332) is formed on the plug (33) to screw with the inner thread (321) in the auxiliary connecting end (325).

The hose-connecting end (322) is located between the combining end (320) and the auxiliary connecting end (325) and is adapted for a hose (A) being attached to the hose-connecting end (322). Consequently, water can be led to the input channel (316) in the input connector (31) from the water source through the hose (B) and be sprayed out from the sprayhead attached to the other hose (A) through the output channel (326) in the output connector (32).

In addition, the input connector (31) further has a disk (313) formed near the combining end (310) to abut against the bottom of the recess (22) in the first reeling wheel (201), and the output connector (32) further has a disk (324) formed near the combining end (320) to abut against the bottom of the recess (22) in the second reeling wheel (202). With the arrangements of the disks (313,324) on the connectors (31,32), the reeling wheels (201,202) will not detach from the connectors (31,32) during the rotation of the reeling wheels (201,202).

The handlebars (25) are pivotally attached respectively inside the pivotal holes (230) in the reeling wheels (201, 202). In an optional embodiment, a neck (251) is formed near one end of each handlebar (25) to form a head (250) on the end. The head (250) is pivotally held in the pivotal hole (230) in the corresponding reeling wheel (201,202).

In such an arrangement, two hoses (A,B) can be wound respectively around the protrusions (21) on the reeling wheels (201,202). One end of each hose (A,B) is connected to the hose-connecting end (314,322) of a corresponding connector (31,32), and the other end extends out of the base (10) from a corresponding one of the notches (14) through the slit (221) in the corresponding reeling wheel (201,202) and is selective connected to a water source or a sprayhead. When the reeling wheels (201,202) are rotated relative to the base (10), the hoses (A,B) can be expanded from or retracted into the reeling device. With the location of the notches (14) at opposite ends of the base (10), the hoses (A,B) can be expanded from the base (10) in different direction. Because there are two hoses (A,B) mounted inside the reeling device, the operation length of spraying is substantially equal to the sum of the length of the hoses (A,B) and is prolonged.

Figure 5:
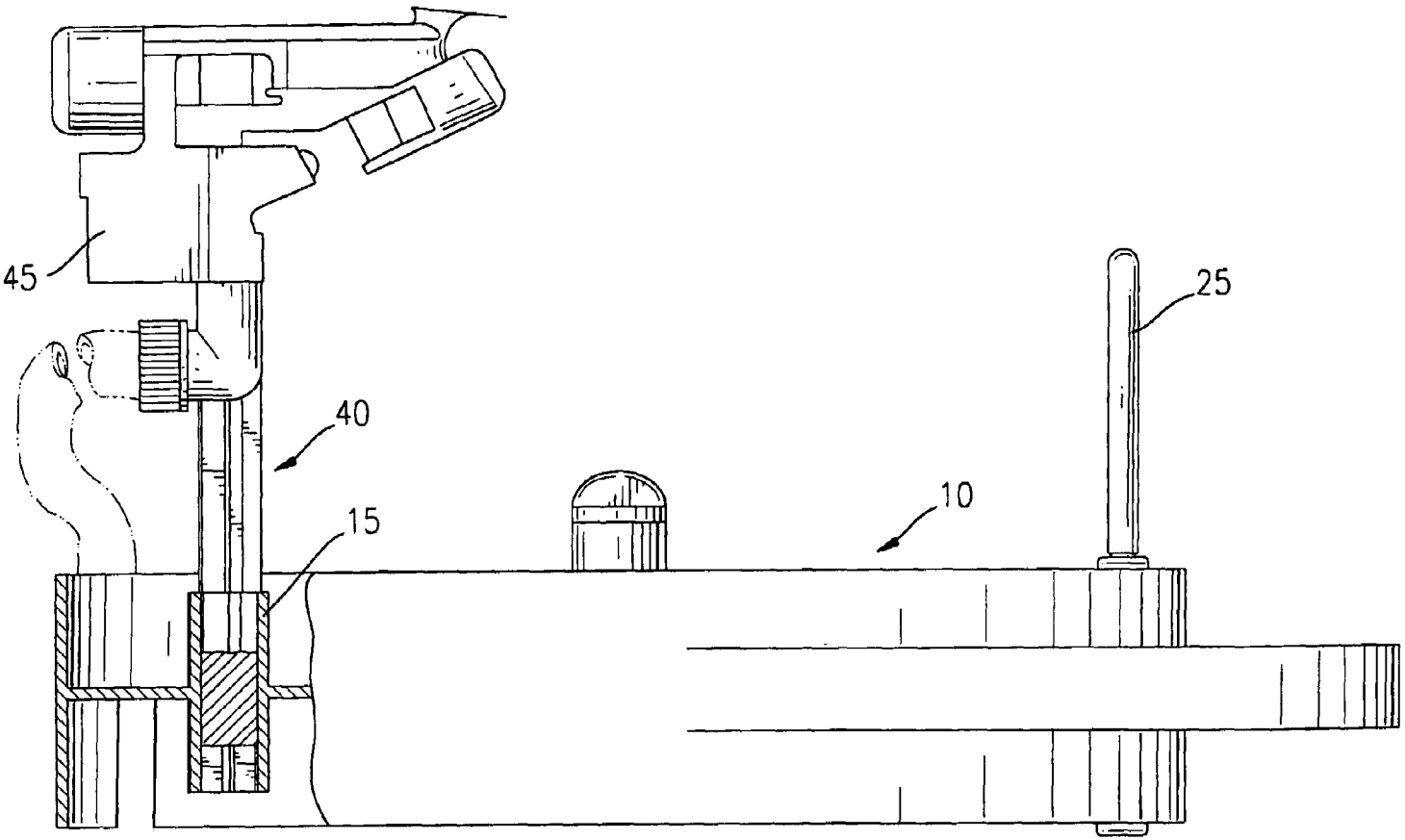
FIG. 5 is an operational side plan view in partial cross section of the connector assembly in FIG. 1 showing that a rod with a sprinkler is connected to the rod mount on the reeling device.
Figure 6:
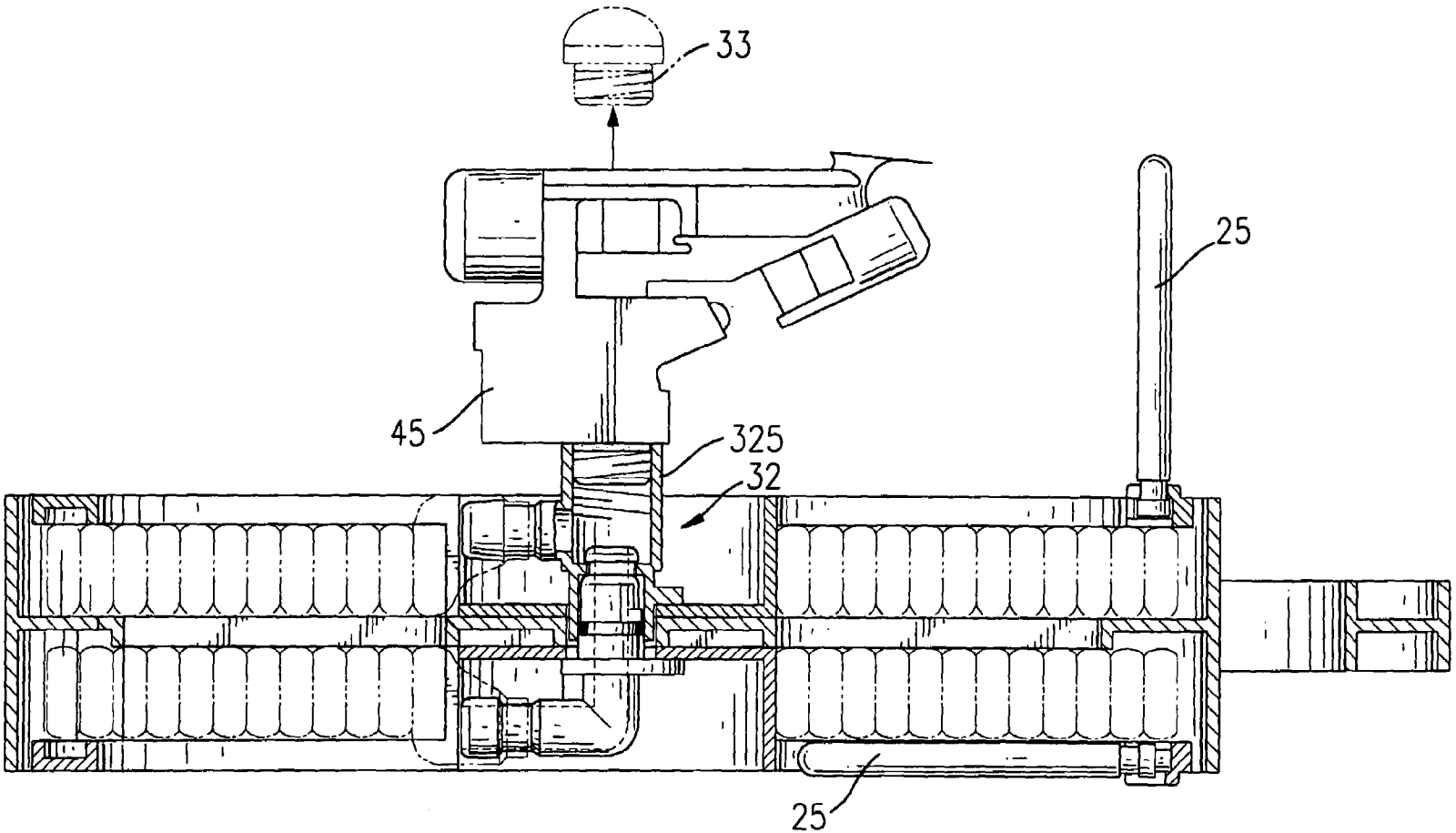
FIG. 6 is an operational side plan view in partial cross section of the connector assembly in FIG. 1 showing that a sprinkler is attached to the output connector of the connector assembly of the reeling device.

With reference to FIGS. 2, 5 and 6, when the handlebar (25) attached to the first reeling wheel (201) is pivotally rotated to be received in the corresponding through hole (23), the reeling device can be put on a flat object to make the second reeling wheel (202) with the output connector (32) facing upward. A rod (40), as shown in FIG. 5 can be inserted into the inserted hole (150) in the rod mount (15) through the through hole (23) in the second reeling wheel (202), and a sprinkler (45) is securely held on the rod (40). Accordingly, the hose (A) connected to the output connector (32) can be connected to the sprinkler (45), such that the reeling device can be served as a stand for supporting the sprinkler (45).

With reference to FIG. 6, the sprinkler (45) can be directly attached to the auxiliary connected end (325) of the output connector (32) after the plug (33) is detached from the output connector (32). Consequently, reeling device can securely support the sprinkler (45) for spraying even when the reeling device is put on a hard ground, such as a concrete ground, and the use of the reeling device is versatile.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A reeling device for hoses comprising:

a base having two sides;

two chambers defined respectively in the sides to form a partition wall between the chambers; and two notches defined in the base and communicating respectively with the chambers;

two reeling wheels including a first reeling wheel and a second reeling wheel rotatably attached respectively inside the chambers in the base for hoses being mounted around the reeling wheels;

a connector assembly attached to the reeling wheels and the base and comprising an input connector attached to the first reeling wheel to rotatably attach the first reeling wheel to the base and having a combining end extending into the base and an input channel defined through the input connector;

an output connector attached to the second reeling wheel to rotatably attach the second reeling wheel to the base and having a combining end extending into the base and connected with the combining end of the input connector and an output channel defined through the output connector and communicating with the input channel in the input connector; and an O-ring mounted between the combining ends of the input connector and the output connector; and two handlebars pivotally attached respectively to the reeling wheels.

2. The reeling device as claimed in claim 1, wherein each reeling wheel has multiple through holes defined through the reeling wheel and each having an inner surface; and a pivotal hole is defined in the inner surface of one of the through holes for one end of one of the handlebars being pivotally attached inside the pivotal hole.

3. The reeling device as claimed in claim 2, wherein each reeling wheel has a protrusion protruding from one side of the reeling wheel and extending into a corresponding chamber in the base for a hose being wound around the protrusion;

a recess defined in the protrusion at a side opposite to the base and having a bottom and an inner surface;

a central hole defined through the bottom of the recess for the combining end of a corresponding one of the input and output connectors extending through the central hole; and a slit defined in the inner surface of the recess and communicating with one of the through holes in the reeling wheel.

4. The reeling device as claimed in claim 3, wherein the input connector is L-shaped and has a hose-connecting end opposite to the combining end and adapted for a hose being attached to the hose-connecting end.

5. The reeling device as claimed in claim 4, wherein the output connector is T-shaped and has an auxiliary connecting end opposite to the combining end and a hose-connecting end located between the combining end and the auxiliary connecting end and adapted for a hose being attached to the hose-connecting end; and a plug is detachably attached to the auxiliary connecting end.

6. The reeling device as claimed in claim 5, wherein the input connector further has a disk formed near the combining end to abut against the bottom of the recess in the first reeling wheel.

7. The reeling device as claimed in claim 6, wherein the output connector further has a disk formed near the combining end to abut against the bottom of the recess in the second reeling wheel.

8. The reeling device as claimed in claim 7, wherein the combining end of the input connector is inserted into the combining end of the output connector;

the input connector has an annular groove defined around the input connector near the combining end; and the output connector has an engaging flange formed inside the output connector near the combining end and engaging with the groove in the input connector to combine the input connector with the output connector.

9. The reeling device as claimed in claim 8, wherein the base further has a handle formed on the base.

10. The reeling device as claimed in claim 9, wherein the base further has two rod mounts formed respectively in the chambers and extending from the partition wall; and each rod mount has a free end and an inserted hole defined in the free end.

11. The reeling device as claimed in claim 1, wherein each reeling wheel has a protrusion protruding from one side of the reeling wheel and extending into a corresponding chamber in the base for a hose being wound around the protrusion;

a recess defined in the protrusion at a side opposite to the base and having a bottom and an inner surface; and a central hole defined through the bottom of the recess for the combing end of a corresponding one of the input and output connectors extending through the central hole.

12. The reeling device as claimed in claim 1, wherein the input connector is L-shaped and has a hose-connecting end opposite to the combining end and adapted for a hose being attached to the hose-connecting end.

13. The reeling device as claimed in claim 12, wherein the output connector is T-shaped and has an auxiliary connecting end opposite to the combining end and a hose-connecting end located between the combining end and the auxiliary connecting end and adapted for a hose being attached to the hose-connecting end; and a plug is detachably attached to the auxiliary connecting end.

14. The reeling device as claimed in claim 13, wherein the input connector further has a disk formed near the combining end to abut against the bottom of the recess in the first reeling wheel; and the output connector further has a disk formed near the combining end to abut against the bottom of the recess in the second reeling wheel.

15. The reeling device as claimed in claim 14, wherein the combining end of the input connector is inserted into the combining end of the output connector;

the input connector has an annular groove defined around the input connector near the combining end; and the output connector has an engaging flange formed inside the output connector near the combining end and engaging with the groove in the input connector to combine the input connector with the output connector.

16. The reeling device as claimed in claim 1, wherein the base further has a handle formed on the base.

17. The reeling device as claimed in claim 1, wherein the base further has two rod mounts formed respectively in the chambers and extending from the partition wall; and each rod mount has a free end and an inserted hole defined in the free end.

* * * * *